US007015634B2

(12) United States Patent
Watanabe et al.

(10) Patent No.: US 7,015,634 B2
(45) Date of Patent: Mar. 21, 2006

(54) PROJECTION TYPE CATHODE RAY TUBE DEVICE

(75) Inventors: Sakae Watanabe, Mutsuzawa (JP); Katsumi Hirota, Urayasu (JP)

(73) Assignee: Hitachi Displays, Ltd., Chiba-ken (JP)

( * ) Notice: Subject to any disclaimer, the term of this patent is extended or adjusted under 35 U.S.C. 154(b) by 66 days.

(21) Appl. No.: 10/612,460

(22) Filed: Jul. 2, 2003

(65) Prior Publication Data

US 2004/0004428 A1 Jan. 8, 2004

(30) Foreign Application Priority Data

Jul. 8, 2002 (JP) ..... 2002-198203

(51) Int. Cl.
*H01J 29/70* (2006.01)
*H01F 1/00* (2006.01)

(52) U.S. Cl. ..... 313/442; 313/431

(58) Field of Classification Search ..... 313/440, 313/412–414, 477 R, 421, 426, 431, 442; 315/370; 335/212

See application file for complete search history.

(56) References Cited

U.S. PATENT DOCUMENTS 4,939,415 A * 7/1990 Iwasaki et al. ..... 313/440
5,378,961 A * 1/1995 Shiro et al. ..... 313/440
6,373,202 B1 * 4/2002 Ito et al. ..... 315/370
6,750,602 B1 * 6/2004 Hirota et al. ..... 313/477 R
2003/0173889 A1 * 9/2003 Tagami et al. ..... 313/440

FOREIGN PATENT DOCUMENTS

JP 7-37526 2/1995
JP 8-287845 11/1996
JP 2001-185053 7/2001

OTHER PUBLICATIONS

Patent Abstracts of Japan; Publication No. 08-287845, Jan. 11, 1996, Projection Cathode-Ray Tube Device.

* cited by examiner

*Primary Examiner*—Karabi Guharay
(74) *Attorney, Agent, or Firm*—Milbank, Tweed, Hadley & McCloy LLP

(57) ABSTRACT

A pair of magnets of which magnetizing direction differs from each other in the horizontal direction (X axis) are arranged at upper and lower portions of a funnel-side opening portion of a deflection yoke. The pair of magnets are held and fixed to a coil support body which supports horizontal deflection coils in a state where the magnets are embedded in the coil support body. In a projection type cathode ray tube of a single electron beam method, a locus of an electric beam which receives the deflection distortion is corrected so as to correct an electron beam shape on a screen to an approximately circular shape whereby a focusing performance of a display image on a screen is enhanced.

6 Claims, 7 Drawing Sheets

PROJECTION TYPE CATHODE RAY TUBE DEVICE

BACKGROUND OF THE INVENTION

1. Field of the Invention

The present invention relates to a cathode ray tube device, and more particularly to a projection type cathode ray tube device which is applicable to a projection type image display device such as a projection type TV receiver, a video projector or the like.

2. Description of the Related Art

In general, three projection type cathode ray tube devices which emit respective colors of red, green and blue are mounted on a projection type image display device, wherein images of respective projection type cathode ray tubes are magnified by respective projection lenses arranged at frontal sides of respective panel portions and are projected onto a screen and synthesized. In each projection type cathode ray tube device, from a phosphor screen toward an electron gun, a deflection yoke, a convergence yoke, an alignment magnet and the like are sequentially mounted and arranged, wherein electron beams irradiated from the electron guns receive a deflection action due to a deflection magnetic field which is generated by a deflection yoke and reach the phosphor screen.

In the projection type image display device, the distortion of luster or the misalignment of three-color luster (also referred to as "color slurring" or "misconvergence") due to the magnetic field generated in a convergence yoke served for aligning the images projected from the above-mentioned three projection type cathode ray tubes on a screen is corrected so as to obtain image with no color slurring. Here, as this type of projection type cathode ray tube device, a cathode ray tube device disclosed in Japanese Unexamined Patent Publication 287845/1996 or the like can be named.

SUMMARY OF THE INVENTION

Recently, to enhance the color slurring correction efficiency while reducing a deflection power supplied to a deflection circuit and enhancing focusing characteristics of a displayed image, there has been developed a projection type cathode ray tube adopting a different-diameter neck system having the constitution in which the outer diameter of a neck portion at a position where a deflection yoke is mounted is made smaller than the outer diameter of the neck portion at a position where an electron gun is housed. BY mounting the above-mentioned convergence yoke for performing the color slurring correction to the neck portion of this projection type cathode ray tube adopting a different-diameter neck system where the outer diameter dimension is relatively small (small neck-diameter portion), it is possible to narrow the inner diameter of the convergence yoke per se and hence, it is possible to enhance the color slurring correction sensitivity on the screen of the projection type image display device.

Further, in improving the above-mentioned focusing characteristics, the effect of the improvement can be enhanced by increasing the diameter of a main lens of the electron gun. Accordingly, by mounting the main lens to the neck portion having a relatively large outer diameter dimension (large neck-diameter portion), the lens diameter can be increased and hence, an image quality on a screen of the projection type image display device can be enhanced. Further, by mounting the deflection yoke as close as possible to the electron gun, the deflection efficiency is enhanced. That is, corresponding to the decrease of the outer diameter dimension of the neck portion, the deflection power can be reduced. To be more specific, the deflection power differs by approximately 25% between a case in which the deflection yoke is mounted on the small-diameter neck portion and a case in which the deflection yoke is mounted on the large-diameter neck portion. The projection type cathode ray tube device adopting the different-diameter neck type projection type cathode ray tube device which mounts the deflection yoke on the small neck-diameter portion and inserts the electron gun in the large neck-diameter portion can exhibit the approximately same image quality compared to the projection type cathode ray tube device which is constituted of only the large neck diameter portion and, at the same time, can suppress a deflection current.

In the projection type cathode ray tube device adopting the different-diameter neck system, mounting of the convergence yoke to the large neck-diameter portion and mounting of the deflection yoke to the small neck-diameter portion are indispensable and hence, the enhancement of the correction sensitivity of color slurring has been considered as a task to be achieved.

However, in the projection type cathode ray tube adopting the different-diameter neck system, electron beams irradiated from the electron guns arranged in the large neck-diameter portion strongly receive an influence of a deflection magnetic field of the deflection yoke, thus generating the distortion of the shape of the electron beams, that is, the so-called deflection distortion relatively in the peripheral portion of a screen.

Accordingly, it is an object of the present invention to provide a projection type cathode ray tube device adopting a different-diameter neck system which can enhance a focusing function of display images and, at the same time, can enhance the color slurring correction efficiency, and further can correct the deflection distortion whereby the image quality in a peripheral portion of a screen can be enhanced.

A projection type cathode ray tube device according to the present invention is constituted such that first magnets having different polarities in the horizontal direction are arranged at upper and lower sides of an opening portion of a deflection yoke, and the first magnet which is arranged at the upper side of the opening of the deflection yoke and the first magnet which is arranged at the lower side of the opening of the deflection yoke have different polarities in the lateral direction. Due to such a constitution, it is possible to correct a locus of an electron beam which enters the inside of a deflection magnetic field and can correct the electron beam distorted in the longitudinal direction to an electron beam shape which is a substantially circular shape.

Another projection type cathode ray tube device according to the present invention is constituted such that first magnets having different polarities in the horizontal direction are arranged at upper and lower sides of an opening portion of a deflection yoke, the first magnet which is arranged at the upper side of the opening of the deflection yoke and the first magnet which is arranged at the lower side of the opening of the deflection yoke have different polarities in the lateral direction, and second magnets having different polarities in the tube axis direction of a cathode ray tube are formed in the periphery of the opening portion of the deflection yoke. Due to such a constitution, it is possible to correct an electron beam which is distorted in the longitudinal direction to an approximately circular shape and to correct an electron beam which is distorted in the radial direction to an approximately circular shape.

BRIEF DESCRIPTION OF THE DRAWINGS

FIG. 2A is a plan view of the device as viewed from the phosphor screen side, and FIG. 2B is a side view the device.

DESCRIPTION OF THE PREFERRED EMBODIMENTS

Preferred embodiments of the present invention are explained hereinafter in conjunction with drawings which show the embodiments.

Figure 1:
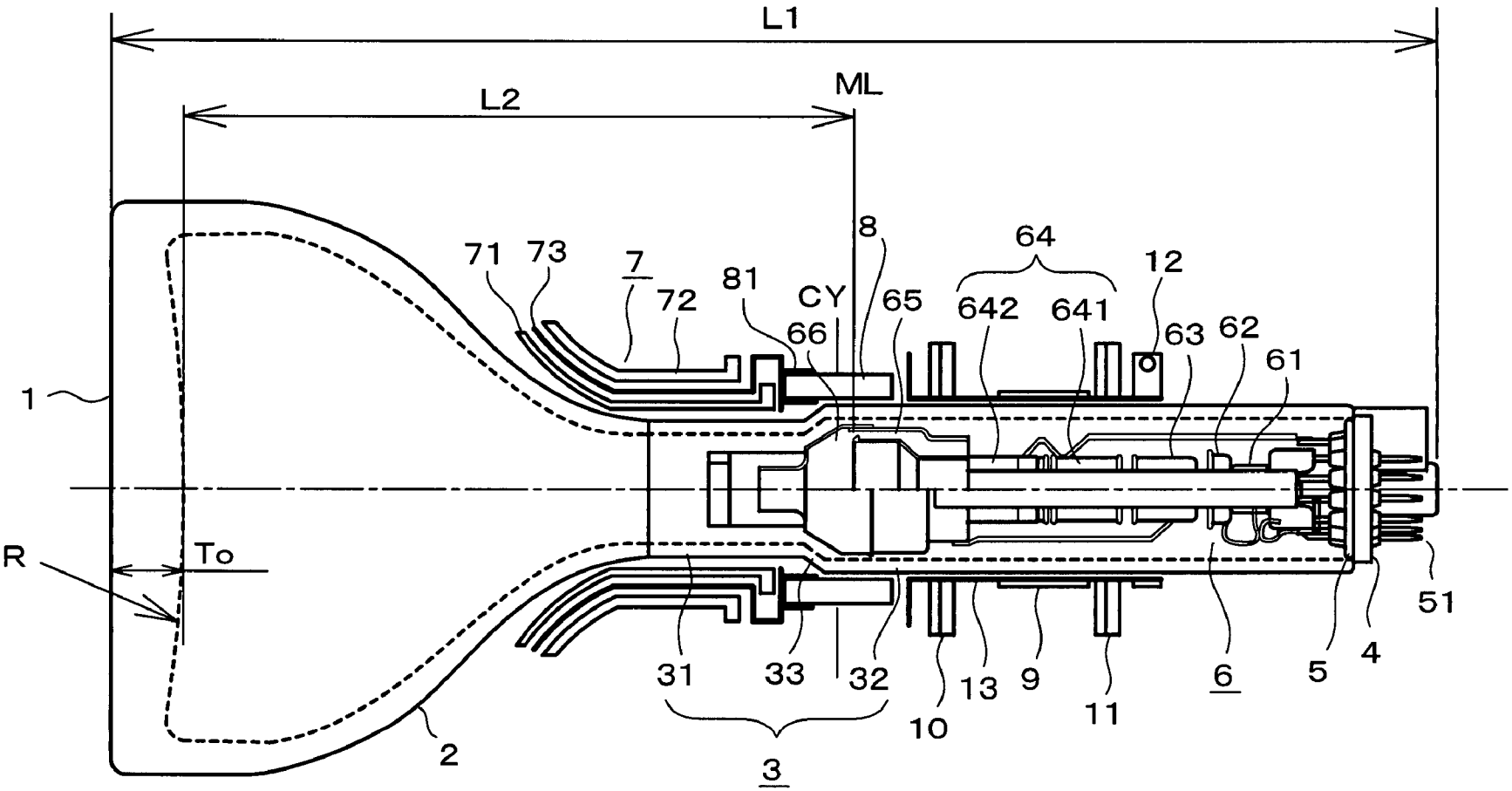
FIG. 1 is a partial cross-sectional view showing the constitution of a projection type cathode ray tube device according to the present invention.

FIG. 1 is a partial cross-sectional view for explaining an embodiment of a projection type cathode ray tube device according to the present invention. In FIG. 1, the projection type cathode ray tube is constituted of a vacuum envelope in which a panel 1 and one end of a neck 3 are connected by way of a funnel 2 and the other end of the neck 3 is sealed by a stem 5. On the stem 5, a plurality of pins 51 which are served for supplying voltages to respective electrodes of an electron gun 6 are mounted in an erected manner. A base 4 is served for protecting the stem 5 and the pins 51.

Further, in the projection type cathode ray tube, a monochromatic and approximately rectangular-shaped phosphor screen is formed on an inner surface of an approximately rectangular panel 1 and one electron beam is irradiated from the electron gun 6. The electron beam receives a deflection action in the horizontal direction as well as in the vertical direction due to a deflection yoke 7 and scans on the phosphor screen, so that the screen is emitted.

The panel 1 has an approximately flat outer surface and an inner surface which is convexed toward the electron gun 6 side, thus forming a convex lens. In this embodiment, the inner surface of the panel 1 is formed in a spherical shape having a radius R of curvature of 350 mm. Further, to reduce the aberration, the inner surface of the panel 1 may be formed in a non-spherical shape. Further, a thickness To of the panel 1 at the center thereof is 14.1 mm. The profile size of the panel 1 in the diagonal direction is set to 7 inches and the size of the effective screen on which a phosphor screen is formed in the diagonal direction is set to 5.5 inches. Further, a total length L1 of the projection type cathode ray tube is set to 276 mm.

The neck 3 includes a small-diameter neck portion 31 which is connected to a funnel 2, a large-diameter neck portion 32 which is sealed to a stem 5 and a neck connecting portion 33 which connects the small-diameter neck portion 31 with the large-diameter neck portion 32. On an outer circumference of a transitional area between the small-diameter neck portion 31 and the funnel portion 2, a deflection yoke 7 is mounted. The outer diameter of the small-diameter neck portion 31 is set to 29.1 mm. Further, the electron gun 6 is housed inside the large-diameter neck portion 32. The outer diameter of the large-diameter neck portion 32 is set to 36.5 mm and is formed to have a size larger than the small-diameter neck portion 31 by 7 mm. The projection type cathode ray tube of a type having the neck which differs in outer diameter is referred to as "cathode ray tube of a different-diameter neck system". Further, in addition to the above-mentioned specific sizes, dimensional errors on manufacturing should be taken into consideration.

In this manner, a horizontal deflection coil 71 and a vertical deflection coil 72 of the deflection yoke 7 which deflects the electron beam are mounted on the small-diameter neck portion 31 having the small outer diameter dimension. Accordingly, it is possible to suppress the deflection power. In this case, the deflection power can be saved by approximately 25% compared to a case in which the neck outer diameter dimension is 36.5 mm. Further, a main lens forming electrode of the electron gun 6 which focuses the electron beam is housed in the large-diameter neck portion 32 having the large outer diameter and hence, it is possible to increase the diameter dimension of the electron lens.

Further, a first grid electrode (control electrode) 61 of the electron gun 6 is formed in a cup shape and a cathode which emits electron beam is housed inside the first grid electrode 61. Further, a second grid electrode (acceleration electrode) 62 forms a prefocusing lens together with the first grid electrode 61. Further, to a third grid electrode (first anode) 63, an anode voltage of approximately 30 kV which is approximately equal to a voltage applied to a fifth grid electrode (second anode) 65 which constitutes a final electrode is applied. In general, the anode voltage of the projection type cathode ray tube is approximately 25 kV or more.

When the beam deflection area and the beam focusing area have different neck outer diameter respectively, the electron gun is arranged away from the phosphor screen due to a mechanical restriction. When the electron gun is arranged away from the phosphor screen, the focusing characteristics of the electron beam is degraded. However, by elevating an anode voltage in the projection type cathode ray tube, it is possible to easily cope with problems on deterioration of focusing. It is possible to operate the projection type cathode ray tube with the maximum anode voltage of approximately 30 kV or more in the projection type cathode ray.

Further, a fourth grid electrode (focusing electrode) 64 is divided into a fourth-grid-electrode first member (focusing-electrode first member) 641 and a fourth-grid-electrode second member (focusing-electrode second member) 642. A focusing voltage of approximately 8 kV is applied to both electrode members. The focusing-electrode second member 642 has a diameter dimension thereof increased at a phosphor screen and the phosphor screen side is inserted into the inside of a second anode 65 to form a final-stage main lens having a large diameter. Corresponding to the increase of the neck outer diameter, the main lens exhibits the more effective improvement of focusing characteristics and can increase a lens diameter. The center position of the final-stage main lens is defined by a phosphor-screen-side distal end portion ML of the focusing-electrode second member 642 and a distance L2 in the tube axis direction from the final-stage lens position ML to the center of an inner surface of the panel 1 is set to 139.7 mm.

Further, since the projection type cathode ray tube requires high brightness, a beam current (cathode current) becomes approximately 4 mA or more. To maintain the high focusing performance even under such a large current, it is extremely important to maintain the diameter of the main lens as large as possible. Since a voltage of the phosphor screen is high in the projection type cathode ray tube, spreading of the beam due to a repulsion of space charge at the time of supplying a large current becomes relatively small and the size of electron beam spots on the phosphor screen at the time of supplying a large current is substantially determined based on spreading of the beam due to the spherical aberration of the electron gun. That is, in the projection type cathode ray tube, the influence caused by increasing the lens diameter of the electron gun is larger than the influence caused by shifting the electron gun away from the phosphor screen with the neck diameter different.

Further, a shield cup 66 is integrally formed with the second anode 65 so as to form the main lens. The phosphor-screen-side diameter of the shield cup 66 is made gradually smaller. According to the decrease of the outer diameter of the neck connecting portion 33 in the vicinity of the distal end of the electron gun 6 is also made smaller, the diameter of the vicinity of the distal end of the electron gun 6 is also made small so as to prevent the electron gun 6 from being arranged far away from the phosphor screen.

In the projection type cathode ray tube adopting a single electron beam method, in contrast to a shadow mask type color cathode ray tube adopting three electron beam method in an in-line arrangement, it is unnecessary to take an impingement of both-side electron beams on an inner wall of the neck into account. In the projection type cathode ray tube adopting the different-diameter neck system according to the present invention, to satisfy both of the reduction of the deflection power and the enlargement of diameter of main lens which are in a trade-off relationship, the neck diameter difference between the large-diameter neck portion 32 and the small-diameter neck portion 31 is made as large as possible. It is effective to set the neck diameter difference to 5 mm or more.

On the other hand, the neck connecting portion 33 which connects the large-diameter neck portion 32 and the small-diameter neck portion 31 defines a region where the neck diameter is gradually changed along the tube axis direction. Accordingly, when the neck diameter difference between the large-diameter neck portion 32 and the small-diameter neck portion 31 becomes large, a length of the neck connecting portion 33 in the tube axis direction is also elongated. When the outer diameter dimension of the large-diameter neck portion 32 is 36.5 mm and the outer diameter dimension of the small-diameter neck portion 31 is 29.1 mm as mentioned previously, the length of the neck connecting portion 33 in the tube axis direction is 8 mm. This neck connecting portion 33 constitutes an extra space.

Further, on the projection type cathode ray tube, a convergence yoke 8, a speed modulation coil 9 and centering magnets 10, 11 are mounted on a region ranging from the deflection yoke 7 to the base 4. The deflection yoke 7 includes horizontal deflection coils 71 which make the electron beam scan in the horizontal direction, vertical deflection coils 72 which make the electron beam scan in the vertical direction, and a coil separator 73 which holds the horizontal deflection coils 71 and the vertical deflection coils 72 at separate positions. The base 4 side of the deflection yoke 7 is mounted on the small-diameter neck portion 31 having the small outer diameter dimension.

Here, although the deflection yoke 7 is not illustrated in detail in this embodiment, to be more specific, the deflection yoke 7 is configured such that the horizontal deflection coils 71 are incorporated into the inside of a coil support body, the vertical deflection coils 72 are incorporated into the inside of a coil support body by way of the coil separator 73, outer surface sides of the vertical deflection coils 72 are covered with by a core made of a magnetic material to be held and fixed, and the deflection yoke 7 is mounted on the small-diameter neck portion 31.

Further, the convergence yoke 8 includes a toroidal coil which generates a convergence magnetic field. The convergence yoke 8 is also arranged to stride over the large-diameter neck portion 32 having the large outer diameter and the neck connecting portion 33 and is mounted on a convergence yoke holder 81 mounted on the base-4-side end portion of the coil separator 73 of the deflection yoke 7. The convergence yoke 8 is mounted on the large-diameter neck portion 32 for preventing a case where when the small-diameter neck portion 31 is extended toward the base 4, the distance L2 from the position ML of the final-stage main lens of the electron gun to the center of the phosphor screen and the total length L1 of the projection type cathode ray tube are excessively elongated.

Further, a convergence yoke 8 has an inner surface thereof formed in an approximately cylindrical surface and has a large inner diameter corresponding to the large-diameter neck portion 32 along the whole tube axis direction. This provision is made to allow mounting of the convergence yoke 8 from the base 4 side. In spite of the fact that the inner diameter of the neck connecting portion 33 of the convergence yoke 8 is equal to the diameter of the large-diameter neck portion 32, a total length of the convergence coil 8 is elongated using the neck connecting portion 33 which constitutes the above-mentioned extra space and hence, it is possible to enhance the color slurring correction sensitivity even when the convergence yoke 8 is not mounted on the small-diameter neck portion 31.

It is also considered to elongate or extend the total length of the convergence yoke 8 toward the base 4 to enhance the color slurring correction sensitivity. However, since neck parts such as speed modulation coil 9, centering magnets 10, 11 and the like are fixed closer to the base 4 than the convergence yoke 8 using a clamp 12 by way of neck part holder 13, it is necessary to consider a provision which prevents the convergence yoke 8 from interfering with these neck parts. Further, there exists a possibility that the tube-axis-direction center position CY of the coil of the convergence yoke 8 is shifted to the base 4 side from the final-stage main lens position ML of the electron gun and effects the focusing action applied to electron beams. Accordingly, it is preferable that the tube-axis-direction center position CY of the convergence yoke 8 is arranged closer to the phosphor screen than the final-stage main lens position ML.

The speed modulation coil 9 is used for enhancing the contrast of images. Since the speed modulation coil 9 is mounted on the large-diameter neck portion 32 having an outer diameter of 36.5 mm, the color slurring correction sensitivity must be taken into consideration. To enhance the sensitivity of the speed modulation coil 9, the focusing electrode 64 is divided into the focusing-electrode first member 641 and the focusing-electrode second member 642, and a gap is formed between the first member 641 and the second member 642 so as to facilitate applying of a magnetic field of the speed modulation coil 9 to the electron beam.

Figure 2A:
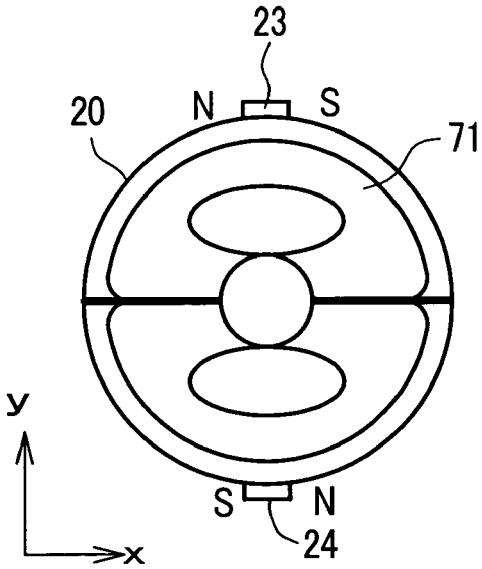
FIG. 2A and FIG. 2B are constitutional view of a deflection yoke for explaining one embodiment of the projection type cathode ray tube device according to the present invention.
Figure 2B:
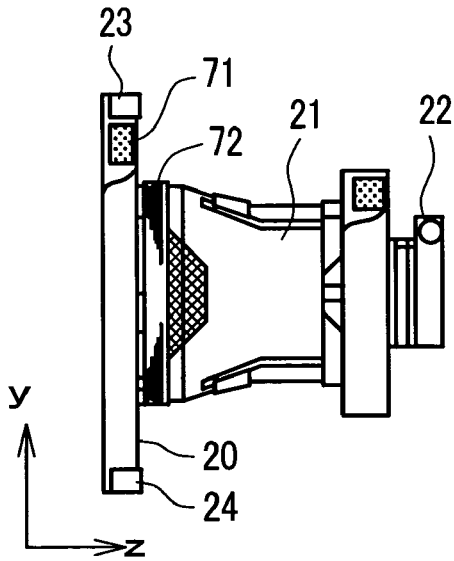

FIG. 2 is a constitutional view of a deflection yoke according to one embodiment of the projection type cathode ray tube device of the present invention. FIG. 2A is a plan view of the device as viewed from the phosphor screen side, and FIG. 2B is a side view the device. Parts identical with the parts shown in FIG. 1 are given same numerals and their explanation is omitted. The deflection yoke is configured such that horizontal deflection coils 71 are assembled into and is held by and fixed to a coil support body 20 which is molded in an approximately funnel shape using synthetic resin material having an insulation performance and a supporting function, and vertical deflection coils 72 are assembled into the inside of the coil support body 20 by way of a coil separator (not shown in the drawing) which is integrally formed with the vertical deflection coil 72. Outside surfaces of the vertical deflection coil 72 are covered with a core 21 made of a magnetic material. The deflection yoke is mounted on the small-diameter neck portion 31 shown in FIG. 1 and is fixed by fastening using a band 22.

Further, on upper and lower portions of a funnel-side opening portion of the horizontal deflection coils 71 of the coil support body 20, a pair of first magnets 23, 24 which have magnetizing directions different from each other in the horizontal direction (parallel to the X axis) are mounted. These pair of first magnets 23, 24 are embedded into and are held by and fixed to the upper and lower portions of the funnel-side opening inside the coil support body 20 which supports the horizontal deflection coils 71. Further, each magnet arranges an N and S poles in the same direction as the direction of the long sides of the panel (parallel to the X axis).

The projection type cathode ray tube adopting a different-diameter neck system has the large neck diameter. Accordingly, when the deflection yoke 7 is assembled prior to mounting thereof to the cathode ray tube, the deflection yoke 7 cannot be mounted from the base 4 side. Accordingly, the deflection yoke 7 should not be mounted after assembling and adjustment and it is necessary to directly mount the deflection yoke 7 to the projection type cathode ray tube and to adjust the deflection yoke 7 thereafter.

Here, in the assembling operation, the horizontal deflection coils 71 are incorporated inside of the coil support body 20 and is held by a coil separator not shown in the drawing and hence, irregularities of mounting attributed to the displacement of mounting position which is liable to easily occur at the time of incorporating the horizontal deflection coils 71 can be reduced.

However, the vertical deflection coils 72 are mounted on an outer surface side of the coil separator to hold the insulation performance with respect to the horizontal deflection coils 71. Accordingly, when the profile dimension of the vertical deflection coils 72 is excessively large, it is impossible to incorporate the core 21.

To facilitate such incorporating of the core 21, it is necessary to provide a type of resilient structure in which the vertical deflection coils 72 which are formed in a pair are combined with each other using a proper force. To absorb the dimensional error of the resilient structure, it is necessary to expand the mating distance dimension between a pair of vertical deflection coils 72.

Figure 3A:
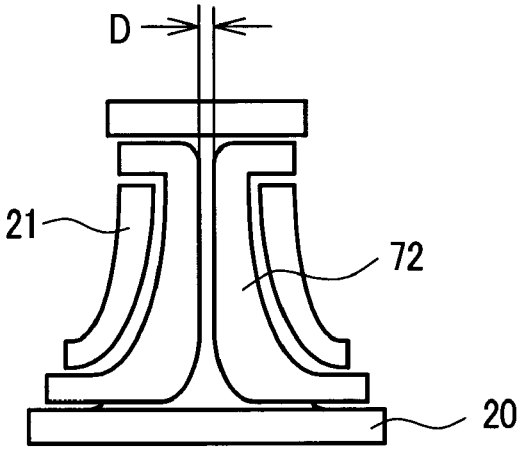
FIG. 3A and FIG. 3B are an explanatory view of the constitution of a vertical deflection coil incorporated into the deflection yoke.
Figure 3B:
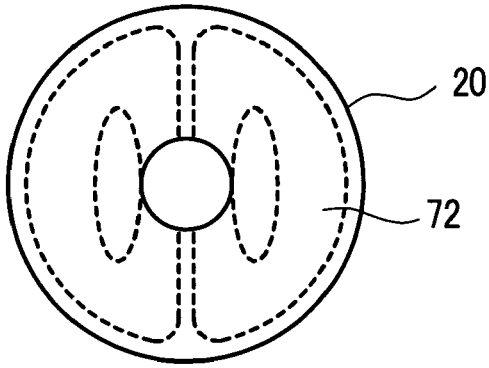

FIG. 3A and FIG. 3B are constitutional views of the vertical deflection coils 72 explained in conjunction with FIG. 2, wherein FIG. 3A is a plan view as viewed from above and FIG. 3B is a plan view as viewed from a phosphor screen side. A distance D between a pair of vertical deflection coils 72 is set to 0.8 mm or less.

Figure 4A:
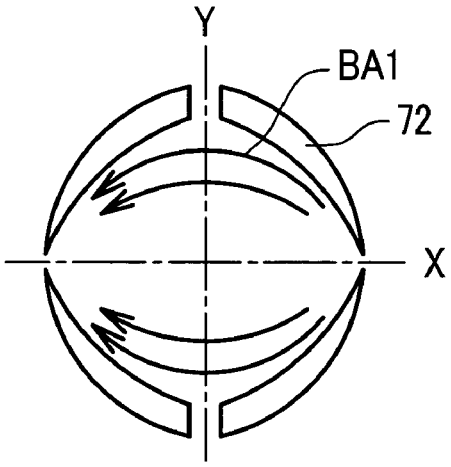
FIG. 4A, FIG. 4B, FIG. 4C and FIG. 4D are schematic view for explaining the change of a barrel magnetic field between coils of a pair of vertical deflection coils.
Figure 4B:
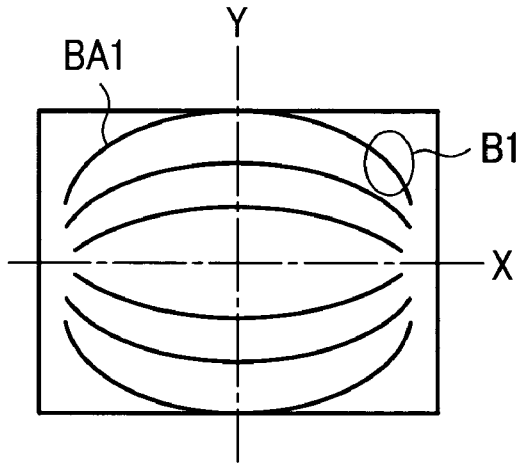
Figure 4C:
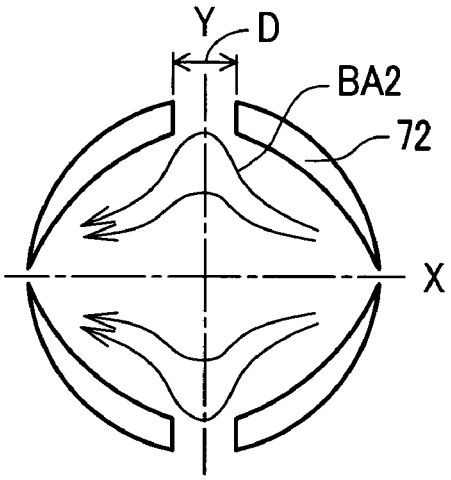

FIG. 4A, FIG. 4B, FIG. 4C and FIG. 4D are schematic views of a magnetic field showing a state in which the magnetic field distribution is changed depending on the distance D between a pair of vertical deflection coils 72. A pair of vertical deflection coils 72 form a barrel magnetic field BA which is referred to as a bulged barrel (barrel shape). When the profile dimension of the vertical deflection coils 72 is smaller than the outer diameter dimension of the coil separator, due to the necessity of widening the mating distance D between a pair of vertical deflection coils 72, the mating distance D is increased as shown in FIG. 4C thus giving rise to a gap.

Further, when a pair of vertical deflection coils 72 are arranged close to each other (distance D being small), the magnetic field is bulged in a barrel shape. When the distance D is large, the magnetic field bulged in a barrel shape is distorted.

The vertical deflection magnetic field has a function of elongating or extending the electron beam in the vertical direction.

FIG. 4A is a cross-sectional view of the vertical deflection coil having the small distance D. FIG. 4B is a view showing the relationship between a magnetic field BA1 generated by the vertical deflection coils shown in FIG. 4A and a passing position of the electron beam. A magnetic field of a region where the electron beam which is deflected to a corner portion of the screen passes has a strong degree of bulging. Accordingly, the electron beam B1 which is deflected to the corner portion of the screen receives a less force in the vertical direction than the electron beam which is deflected on the Y axis in the screen.

Figure 4D:
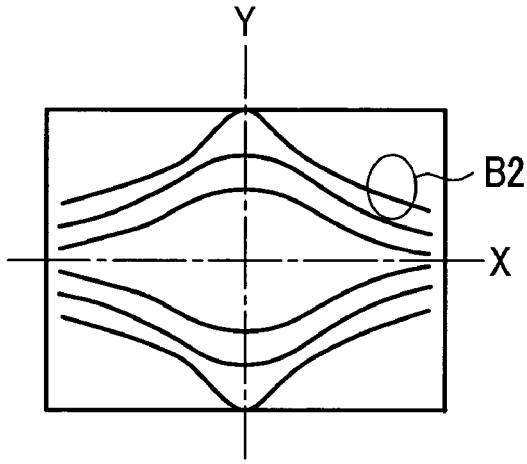

FIG. 4C is a cross-sectional view of the vertical deflection coil having the large distance D. FIG. 4D is a view showing the relationship between a magnetic field BA2 generated by the vertical deflection coil shown in FIG. 4C and a passing position of the electron beam. When the distance D is large, a deflection magnetic field enters the gap and hence, the deflection magnetic field is distorted. In the vicinity of the Y axis where the distance D is large, the magnetic field BA2 exhibits the large degree of bulging and exhibits the small degree of bulging at a position remote from the Y axis.

The degree of bulging of the magnetic field BA2 in the vicinity of the gap is strong and hence, the magnetic field is inclined. Accordingly, the electron beam which passes the inclined magnetic field receives the weak force acting on in the vertical direction. On the other hand, at the position remote from the Y axis, the degree of bulging of the magnetic field BA2 which is bulged in a barrel shape is weak. Accordingly, with respect to the electron beam B2 which is deflected to the corner portion of the screen, the force which the electron beam B2 receives in the vertical direction from the deflection magnetic field is stronger than the force which the electron beam B1 shown in FIG. 4B receives in the vertical direction from the deflection magnetic field. As a result, the electron beam B2 exhibits a distorted electron beam spot shape on the screen.

Figure 5A:
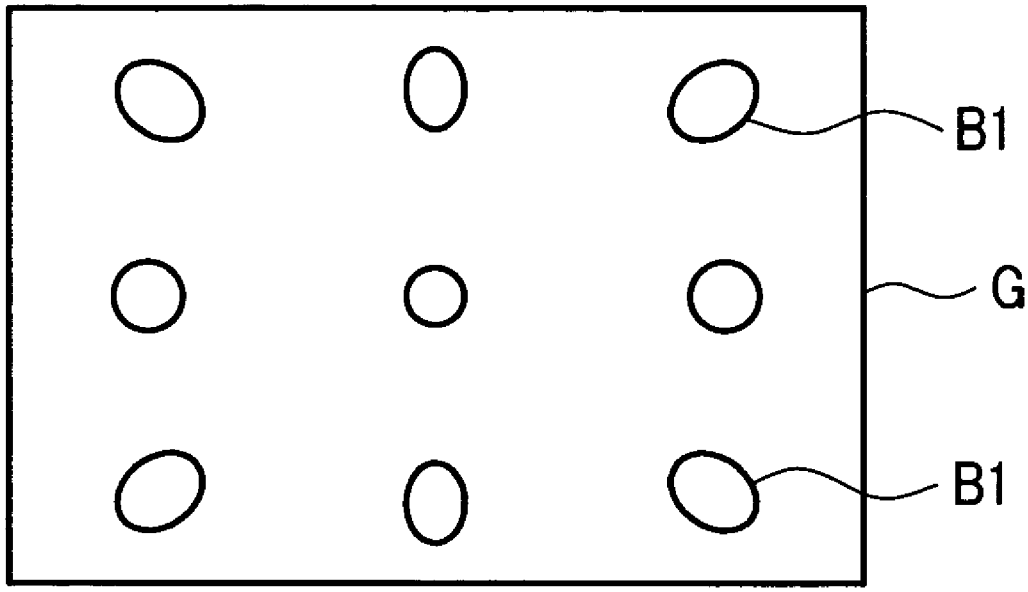
FIG. 5A and FIG. 5B is a schematic view showing a shape of an electron beam on a screen affected by a deflection distortion generated by a horizontal deflection coil.

FIG. 5A is a view showing the electron beam spot shapes on the screen. The magnetic field distribution is adjusted such that, in a state where the left and right vertical deflection coils 72 are brought into contact with each other, the spot shape of the electron beam assumes a circular shape at respective portions of the screen (a phosphor screen) G. Here, although some deformation of shape due to the geometric dimensional difference between the electron gun and the screen G cannot be obviated, it is preferable that the spot shape of the electron beam assumes a circular shape substantially over the whole region of the screen G.

Figure 5B:
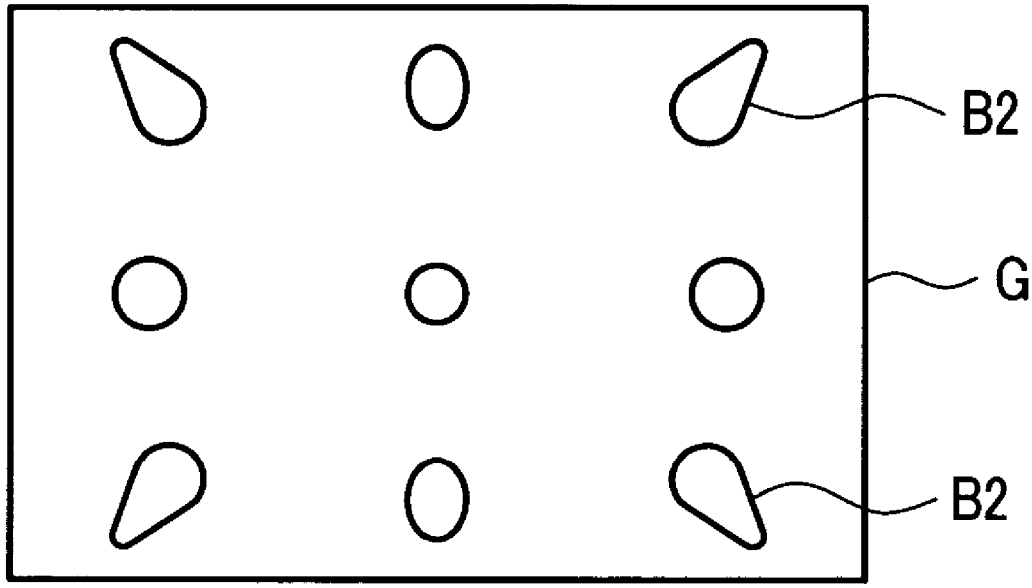

However, there may be a case where the distance D is increased at the time of assembling the deflection yoke. FIG. 5B shows the spot shape of the electron beam when the vertical deflection coils shown in FIG. 4B are used. Since the electron beam B2 receives a strong force in the vertical direction, the spot shape of the electron beam on the screen G is distorted. In an actual operation, the electron beam also receives a horizontal deflection component and hence, the spot shape of the electron beam on the screen G assumes a shape which is extended in the radial direction.

It is possible to change the spot shape of the electron beam on the screen G by changing the distance D between the vertical deflection coils. However, the screen corner portions and the spot shape of the electron beam at the upper and lower portions of the screen have the trade-off relationship. That is, when the distance D between the vertical deflection coils is widened, the electron beam which is deflected toward the corner portion of the screen receives a strong force by which the electron beam is elongated in the vertical direction, while the electron beam which is deflected to the upper and lower portions of the screen receives a weak force by which the electron beam is elongated in the vertical direction.

On the other hand, when the distance D between the vertical deflection coils is narrowed, the electron beam which is deflected toward the corner portion of the screen receives a weak force by which the electron beam is elongated in the vertical direction, while the electron beam which is deflected to the upper and lower portions of the screen receives a strong force by which the electron beam is elongated in the vertical direction.

In this manner, the relationship between the upper and lower portions and the corner portions on the screen G and the mating distance D of the vertical deflection coils 72 has the trade-off relationship. To improve this relationship, the upper and lower portions of the screen G correct the locus of the electron beam which enters the inside of the deflection yoke 7 using a pair of magnets 23, 24, thus correcting the shape of the electron beam on the screen.

Figure 6:
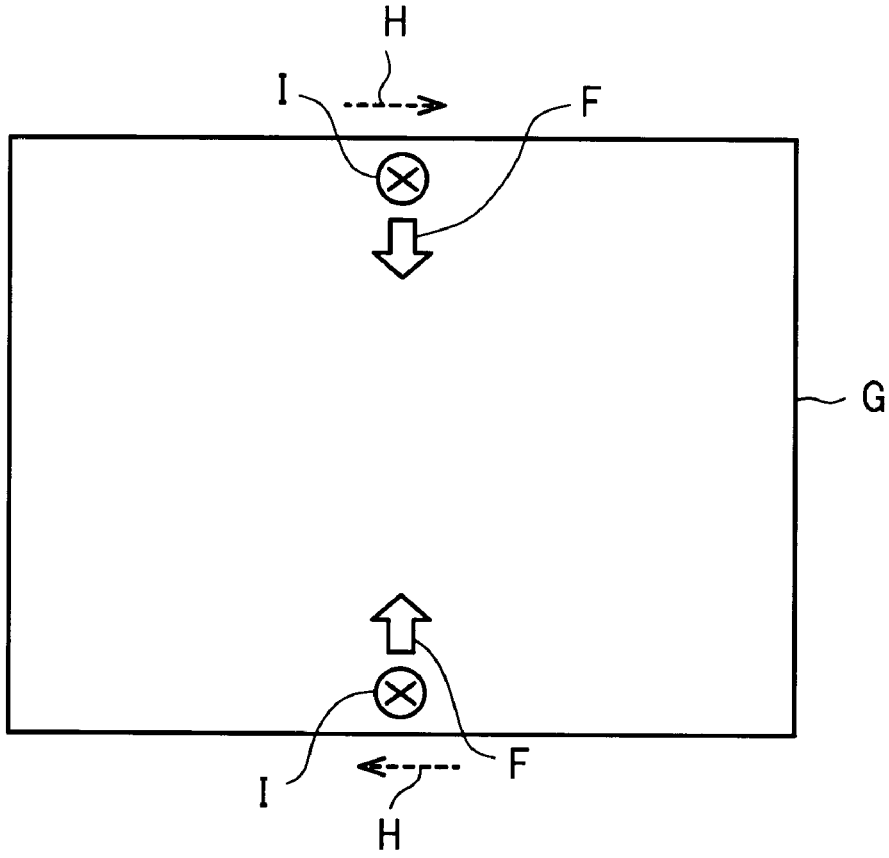
FIG. 6 is a schematic view for explaining a state in which a locus of the electron beam is corrected by the deflection yoke.

FIG. 6 is a schematic view for explaining the correction state of the locus of the electron beam on the screen G due to the constitution in which a pair of magnets 23, 24 which differ in magnetizing direction from each other are arranged at the upper and lower portions of the opening portion of the deflection yoke 7 explained in conjunction with FIG. 2. In FIG. 6, assuming the direction of a current as I and the direction of magnetic field generated by a pair of magnets 23, 24 as H, the direction F to which the correction is applied acts toward the center of the screen as indicated by a white-matted arrow based on the Fleming's rule.

Figure 7:
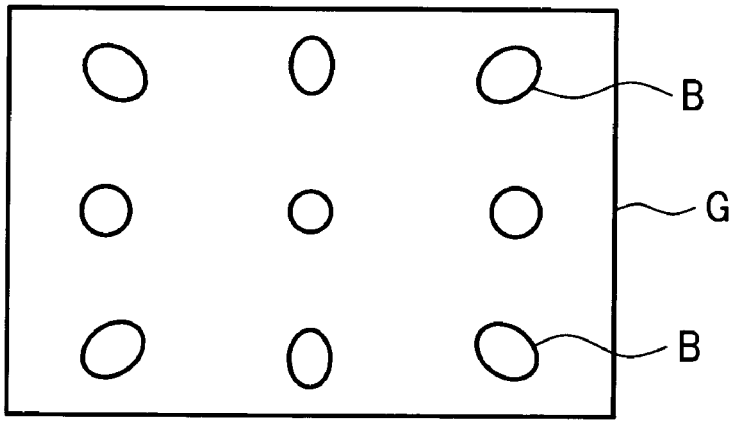
FIG. 7 is a schematic view showing a shape of an electron beam on a screen due to horizontal deflection yokes.

Due to this correction direction F, elliptical electron beams B which are generated at upper and lower points of the screen G are corrected into the electron beam B shape having an approximately circular shape as shown in FIG. 7. As a result, it is possible to obtain the electron beam shape which is substantially equal to an ideal electron beam shape when the electron beam receives no influence of deflection distortion.

Further, in addition to such a constitution, by setting the mating distance D between a pair of above-mentioned vertical deflection coils 72 to 0.8 mm or less, it is possible to absorb the dimensional error at the time of assembling the deflection yoke 7 and, at the same time, the assembling is facilitated. Further, the locus of the electron beam can be corrected and the electron beam shape can be corrected into an approximately circular shape so that the approximately circular shape electron beam can be obtained In this manner, it is possible to obtain both advantageous effects at the same time.

Figure 8A:
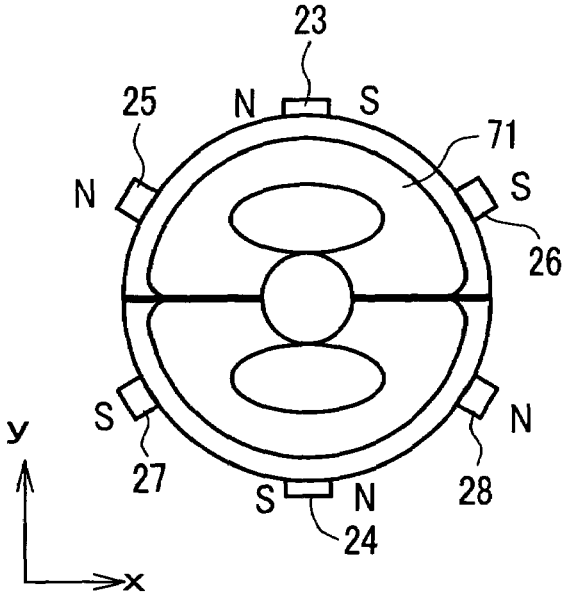
FIG. 8A and FIG. 8B are constitutional view of a deflection yoke of another embodiment of the projection type cathode ray tube device according to the present invention.
Figure 8B:
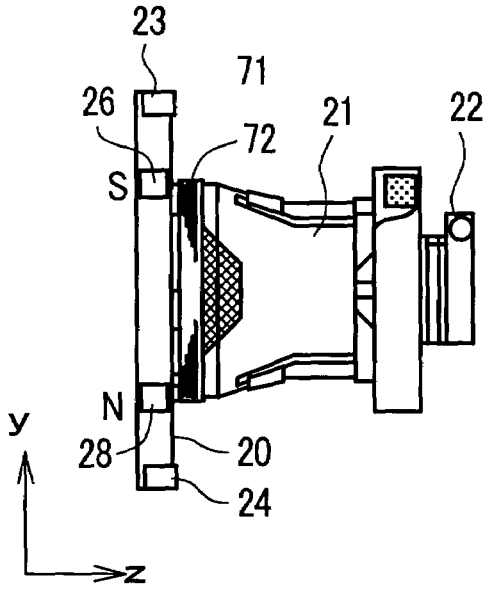

FIG. 8A and FIG. 8B are constitutional views of a deflection yoke for explaining another embodiment of the projection type cathode ray tube device according to the prevent invention. FIG. 8A is a plan view of the deflection yoke as viewed from a phosphor screen side and FIG. 8B is a side view of the deflection yoke. Parts identical with the parts shown in FIG. 2 are given the same symbols and their explanation is omitted. A pair of first magnets 23, 24 are arranged at upper and lower portions of a coil support body 20 which is formed in a funnel shape. Two pairs of second magnets 25, 26, 27, 28 which differ from each other in magnetizing direction in the tube axis direction (Z axis direction) are arranged between the pair of first magnets 23, 24 in the circumferential direction with a given interval. Mounting of these two pairs of magnets 25, 26, 27, 28 is performed such that these magnets are mounted, held and fixed at the opening portion side of the horizontal deflection coils 71 inside the coil support body 20 and in the same direction as the tube axis direction.

In this case, among these two pairs of magnets 25, 26, 27, 28, the first pair of magnets 25 and 26 are respectively arranged with a distance of 25 degree±10 degree from Y axis direction to the circumferential direction with respect to the magnet 23 arranged on the upper portion of the opening of the deflection yoke 7. Further, the second pair of magnets 27 and 28 are also respectively arranged with a distance of 25 degree±10 degree from Y axis direction to the circumferential direction with respect to the magnet 24.

Figure 9:
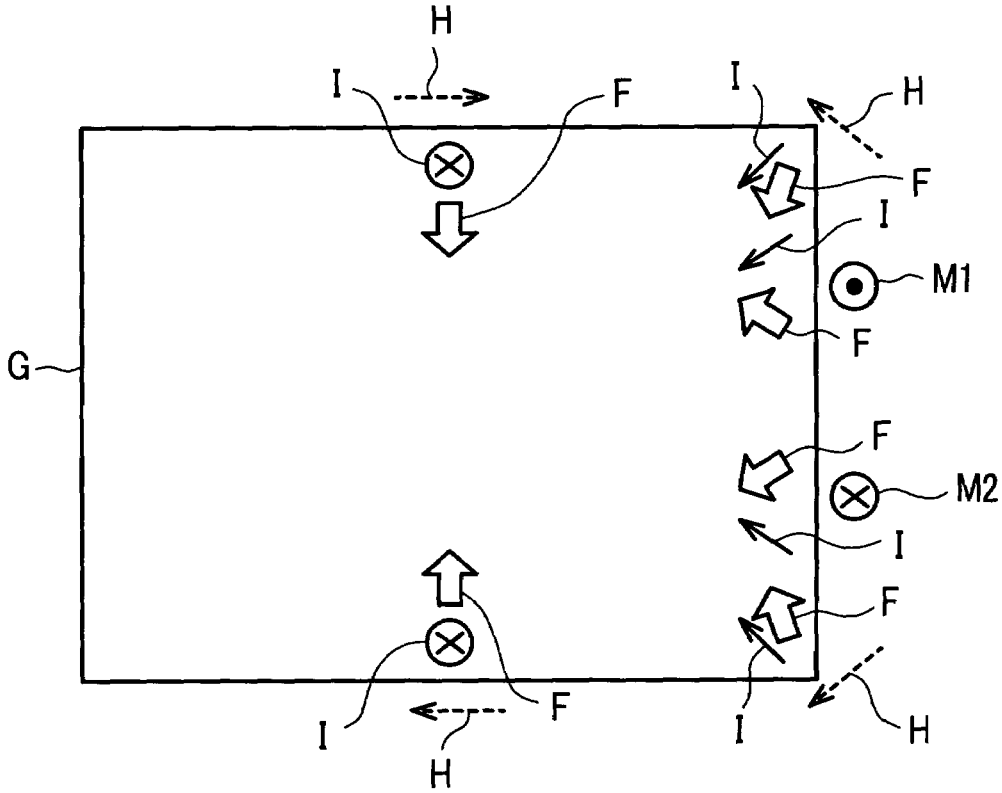
FIG. 9 is a schematic view for explaining a state in which a locus of the electron beam is corrected by the deflection yoke.

FIG. 9 is a schematic view for explaining a correction state of an electron beam locus on a screen G obtained by the following constitution. A pair of magnets 23, 24 are arranged at upper and lower portions of a coil support body 20 at the opening portion of the deflection yoke 7. Two pairs of magnets 25, 26, 27, 28 which differ from each other in the magnetizing direction in the tube axis direction (Z axis direction) are arranged with a given distance between the pair of magnets in the circumferential direction.

In FIG. 9, assuming the direction of a current which flows toward the deflection center of the electron beam as I and the direction of magnetic fields generated by a pair of magnets 26, 28 as M1, M2, the direction F to which the correction is applied acts toward the X axis as indicated by a white-matted arrow based on the Fleming's rule. Here, in FIG. 9, the action of the right-side portion as viewed toward the screen G, that is, the action of a pair of magnets 26, 28 is only explained. However, with respect to the action of a pair of magnets 25, 27 which are arranged in the direction symmetrical with respect to the Y axis, although not shown in the drawing, such an action takes the geometric symmetry with respect to the Y axis at the left-side portion of the screen G and acts toward the X axis direction in the same manner.

Due to such a constitution, it is possible to correct not only the elliptical electron beams B generated at the upper and lower points on the screen Gas shown in FIG. 5B but also elliptical electron beams generated at respective right and left points on the screen G into the approximately circular electron beam B shape shown in FIG. 7. As a result, it is possible to obtain the electron beam shape which is substantially equal to the shape of the ideal electron beam B when the electron beam B is not affected by the deflection distortion as shown in FIG. 5A over the entire region of the screen G.

Further, in such a constitution, the first pair of magnets 25 and 26 are arranged respectively at an interval within a range of 25 degree±10 degree from the Y axis foward the circumferential direction with respect to the magnet 23 at the upper portion of the opening of the deflection yoke 7, and the second pair of magnets 27 and 28 are also arranged respectively at an interval within a range of 25 degree±10 degree from the Y axis toward the circumferential direction with respect to the magnet 24. In this manner, by mounting the respective magnets 25, 26, 27 and 28 suitably adjusting the arrangement position of respective magnets 25, 26, 27 and 28 within the above-mentioned range of ±10 degree, it is possible to cope with not only a screen area of 4:3 which is usually used in the projection type cathode ray tube device but also with a wide screen area of 16:9 and can obtain image qualities (focusing) substantially equal to those of a large diameter lens without increasing the deflection power.

Figure 10:
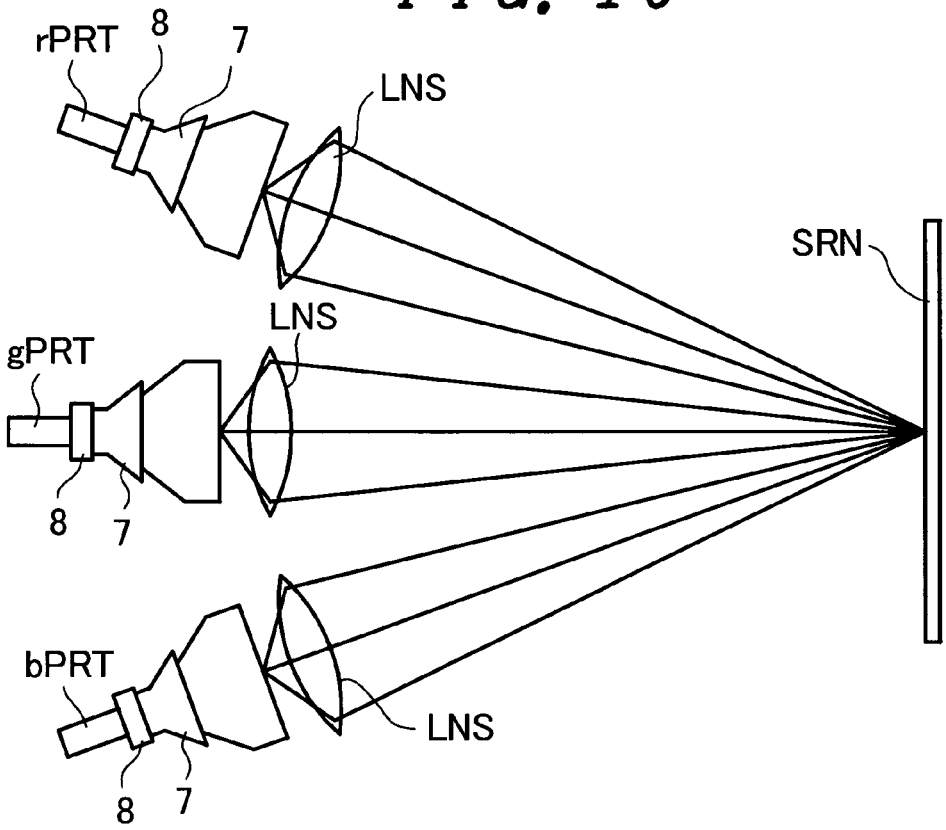
FIG. 10. is a schematic view showing a concept of a system of a projection type TV.

FIG. 10 is a schematic view showing a system concept of a projection TV receiver. In the projection TV receiver, as shown in FIG. 10, images from three projection type cathode ray tube devices consisting of a red projection type cathode ray tubes device rPRT, a green projection type cathode ray tube device gPRT and a blue projection type cathode ray tube device bPRT are converged on a screen SRN after passing through respective lenses LNS so as to form a projected image. Although the rough adjustment of the convergence is performed by inclining respective projection type cathode ray tubes from each other, the fine adjustment is performed by the convergence yokes 8 mounted on respective projection type cathode ray tubes.

Figure 11:
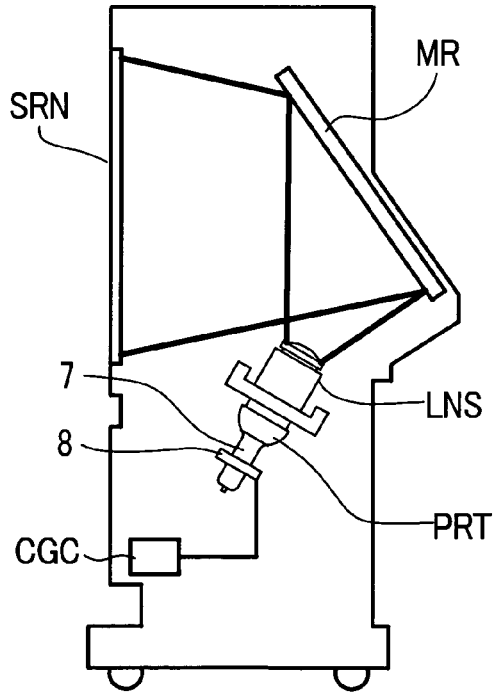
FIG. 11 is a schematic cross-sectional view of a back-surface projection type TV.

FIG. 11 is a schematic cross-sectional view of a back-surface projection TV receiver. The image projected from the projection type cathode ray tube PRT is magnified by the lens LNS, is reflected on the mirror MR and is projected onto the screen SRN. A convergence driving circuit CGC is connected to the convergence yokes 8 mounted on the projection type cathode ray tubes PRT. By providing a pair of magnets or by further providing at least another pair of magnets to the deflection yoke 7 mounted on the projection type cathode ray tube of the present invention, it is possible to project the image having favorable focusing characteristics onto the screen SRN.

Further, since the projection TV receiver uses three projection type cathode ray tubes, the projection TV receiver exhibits the deflection power saving effect and the electron beam shape correction effect which is three times higher than that of a usual TV receiver. Further, the projection TV receiver usually has a large screen of which diagonal size is nominal 40 inches or more. In such a large screen, scanning lines become apparent thus deteriorating the image quality when usual NTSC signals are used. To prevent this phenomenon, in the projection TV receiver, the ADVANCED TV method which has a large number of scanning lines is adopted in many cases. In these cases, the number of scanning lines becomes two or three times larger than that of the usual NTSC method so that the deflection power is increased. Further, the color slurring correction of high accuracy is required. Accordingly, with the use of the projection type cathode ray tube according to the present invention, without increasing the deflection power in the projection TV receiver, it is possible to obtain the great advantageous effect on the enhancement of the focusing characteristics brought about by the electron beam shape correction effect.

Here, although the present invention has been explained with respect to a case in which the present invention is applied to the projection type cathode ray tube for different-diameter neck method projection as the projection type cathode ray tube, the present invention is not limited to such a projection type cathode ray tube and it is needless to say that the substantially same advantageous effects can be obtained by applying the present invention to a general projection type cathode ray tube which uses three projection type cathode ray tubes.

As has been described heretofore, according to the projection type cathode ray tube of the present invention, by arranging a pair of magnets which differ in magnetizing direction from each other in the longitudinal direction at the upper and lower portions of the opening portion of the deflection yoke, the locus of the electron beam which receives the deflection distortion can be corrected so as to correct the electron beam shape on the upper and lower points on the screen into the substantially circular shape whereby it is possible to obtain the extremely excellent advantageous effect that the focusing performance on the screen can be largely enhanced and hence, the display image which is close to normal video signals can be reproduced.

Further, according to another projection type cathode ray tube device of the present invention, at least one pair of magnets which are magnetized in the same direction as the tube axis direction are arranged in the circumferential direction between a pair of magnets which are arranged at upper and lower portions of the opening portion of the deflection yoke and differ in the magnetizing direction from each other. Accordingly, the locus of the electron beam which receives the deflection distortion can be corrected so as to correct the electron beam shape over the whole region of the screen into the substantially circular shape whereby it is possible to obtain the extremely excellent advantageous effect that the focusing performance on the whole region of the screen can be largely enhanced and hence, the display image which is close to normal video signals can be reproduced.

What is claimed is:

1. A projection type cathode ray tube device comprising a vacuum envelope which includes a rectangular panel portion having a phosphor screen formed on an inner surface thereof, a neck portion housing an electron gun which irradiates an electron beam inside thereof, a funnel portion for connecting the panel portion and one end of the neck portion, and a stem portion for sealing the other end of the neck portion, a deflection yoke which makes the electron beam scan on the phosphor screen, and a convergence yoke, wherein the neck portion includes a first neck portion which is arranged at the funnel portion side and has a first outer diameter, a second neck portion which is arranged closer to the stem portion side than the first neck portion and has a second outer diameter, and a third neck portion which connects the first neck portion with the second neck portion, wherein the first outer diameter is smaller than the second outer diameter, the deflection yoke is arranged in a transitional region between the funnel portion and the first neck portion and the convergence yoke is arranged to stride over the second neck portion and the third neck portion, and first magnets which have different polarities from each other in the horizontal direction are arranged at upper and lower positions of a funnel-side opening portion of the deflection yoke as the electron beam which is deflected to the upper and lower portions of the screen receives a force to a center direction of the screen, and the first magnet arranged at the upper side of said opening portion and the first magnet arranged at the lower side of said opening portion differ in polarity at left and right sides.

2. A projection type cathode ray tube device according to claim 1, wherein the deflection yoke includes a coil support body which holds and fixes a pair of horizontal deflection coils thereto, and the first magnets are mounted and fixed to the coil support body.

3. A projection type cathode ray tube device according to claim 1, wherein the deflection coil is arranged in a state where a distance between vertical deflection coils is set to 0.8 mm or less.

4. A projection type cathode ray tube device comprising a vacuum envelope which includes a rectangular panel portion having a phosphor screen formed on an inner surface thereof, a neck portion housing an electron gun which irradiates an electron beam inside thereof, a funnel portion for connecting the panel portion with one end portion of the neck portion, and a stem portion for sealing the other end of the neck portion, a deflection yoke which makes the electron beam scan on the phosphor screen, and a convergence yoke, wherein the neck portion includes a first neck portion which is arranged at the funnel portion side and has a first outer diameter, a second neck portion which is arranged closer to the stem portion side than the first neck portion and has a second outer diameter, and a third neck portion which connects the first neck portion with the second neck portion, wherein the first outer diameter is smaller than the second outer diameter, the deflection yoke is arranged in a transitional region between the funnel portion and the first neck portion and the convergence yoke is arranged to stride over the second neck portion and the third neck portion, first magnets which have different polarities from each other in the horizontal direction are arranged at upper and lower positions of a funnel-side opening portion of the deflection yoke as the electron beam which is deflected to the upper and lower portions of the screen receives a force to a center direction of the screen, and the first magnet arranged at the upper side of said opening portion and the first magnet arranged at the lower side of said opening portion differ in polarity at left and right sides, and second magnets which have polarities different from each other in the tube axis direction of the cathode ray tube are arranged in a circumference of said opening portion of the deflection yoke.

5. A projection type cathode ray tube device according to claim 4, wherein the deflection yoke includes a coil support body which holds and fixes horizontal deflection coils thereto, and the first magnets are mounted and fixed to the coil support body.

6. A projection type cathode ray tube device according to claim 4, wherein the deflection coil is arranged in a state where a distance between vertical deflection coils is set to 0.8 mm or less.

* * * * *